US008893415B2

(12) United States Patent
Andersen

(10) Patent No.: US 8,893,415 B2
(45) Date of Patent: Nov. 25, 2014

(54) RETRO-REFLECTIVE GRAPHIC DISPLAY

(75) Inventor: John C. Andersen, Union, MS (US)

(73) Assignee: John C. Andersen, Union, MS (US)

( * ) Notice: Subject to any disclaimer, the term of this patent is extended or adjusted under 35 U.S.C. 154(b) by 29 days.

(21) Appl. No.: 13/594,795

(22) Filed: Aug. 25, 2012

(65) Prior Publication Data

US 2014/0053438 A1 Feb. 27, 2014

(51) Int. Cl.
*G09F 3/00* (2006.01)

(52) U.S. Cl.
USPC ..... 40/582

(58) Field of Classification Search
USPC ..... 40/582
See application file for complete search history.

(56) References Cited

U.S. PATENT DOCUMENTS 2,060,055 A * 11/1936 Eichelsdoerfer ..... 40/591
2,142,571 A * 1/1939 Menke ..... 40/582
2,236,068 A * 3/1941 Rapp ..... 40/620

* cited by examiner

*Primary Examiner* — Casandra Davis

(57) ABSTRACT

An improved reflective yard sign that allows a user to select their own message and gives a user the option of choosing different interchangeable messages and different interchangeable reflectors. The sign includes at least one interchangeable reflector, at least one interchangeable graphic, and a least one clear lens. Front and back covers are fastened together to retain the reflector, graphic and lens. At least one of the covers includes an aperture through which the lens, graphic, and reflector may be viewed.

9 Claims, 3 Drawing Sheets

RETRO-REFLECTIVE GRAPHIC DISPLAY

FIELD OF THE DISCLOSURE

Reflective yard signs.

PRIORITY

This application does not claim the priority date of any other applications.

BACKGROUND OF THE INVENTION

Yard signs are commonly used to convey information. They may advertise that a home is for sale, display an address, identify a preference for a sports team, show support for a political candidate, or convey numerous other written or visual representations. Such signs are often constructed of plastic, metal, or wood and usually include a message printed on a flat display surface. Yard signs may also be constructed of reflective materials.

Reflective yard signs are often small, monochromatic round reflectors mounted on a stake. They have many uses, such as marking the ends of a driveway so the driveway may be easily seen at night. The round reflective yard signs are inexpensive to manufacture, but they do not give the user the ability to select their own message for display or manipulate the sign to display interchangeable messages. Noble (U.S. Pat. No. 6,845,580) discloses a prior art reflective yard sign with multiple layers permanently secured together with an adhesive. Noble's adhesive construction is a drawback because it prevents a user from being able to use one sign to display multiple, interchangeable messages, and it prevents a user from being able to change the sign's appearance by utilizing interchangeable reflectors. Additionally, adhesive construction is disadvantageous because the adhesive is likely to degrade over time, obscuring images on the sign and rendering the sign ineffective. Accordingly, there is a need for a reflective yard sign that allows a user to select their own messages and give a user the option of choosing different interchangeable messages and reflectors.

SUMMARY OF THE INVENTION

The present invention is an improved reflective yard sign that solves problems associated with the prior art by allowing users to choose among different interchangeable messages and reflectors. According to one embodiment, the retro-reflective graphic display comprises interchangeable components that are assembled to create a two sided reflective yard sign. In this embodiment, the innermost component is a center backing member. Front and back interchangeable reflectors are placed on either side of the center backing member. The reflectors are formed of a material that incorporates retro-reflective cube corners on one side of the reflectors.

Front and back graphics are placed on the outer side of the interchangeable reflectors. In one embodiment, the graphics comprise images incorporated on the surface of a transparent material. The images may be changed by inserting different graphics, and any letter, numeral, symbol, or other type of image may be used. In other embodiments, the graphics may comprise images that are incorporated directly on the front side of the reflectors.

Front and back clear lenses are placed on the outer sides of the graphics. Front and back covers are placed on the outer sides of the lenses. The covers contain an aperture through which the other components can be viewed. The inner edges of the covers contain a means for fastening the covers together, and the lenses, graphics, reflectors, and backing member are retained within the assembled covers in a non-adhesive manner.

The retro-reflective graphic display may be manufactured in a number of shapes, including, but not limited to a circle, rectangle, triangle, or pentagon. The display could similarly be made in the shape of a football, cross, waving flag, tractor, or virtually any other shape. The retro-reflective graphic display may incorporate a number of means for mounting the display. The mounting means include but are not limited to an aperture for receiving a stake, an aperture for receiving a fastener such as a nail or screw, or an adhesive.

In one embodiment, the retro-reflective graphic display may be one sided. The back cover of a one sided display is molded to form the back portion of a frame and does not contain an aperture. An interchangeable reflector is placed inside the back cover, a graphic is placed in front of the reflector, a lens is placed over the graphic, and then a front cover is fastened to the rear cover to retain the lens, graphic, and reflector. Like the two sided version, the front cover forms an aperture through which the lens, graphic, and reflector may be seen.

Accordingly, the retro-reflective graphic display provides an improved reflective yard sign that allows a user to select their own message and gives a user the option of choosing different interchangeable messages.

DETAILED DESCRIPTION

Figure 1:
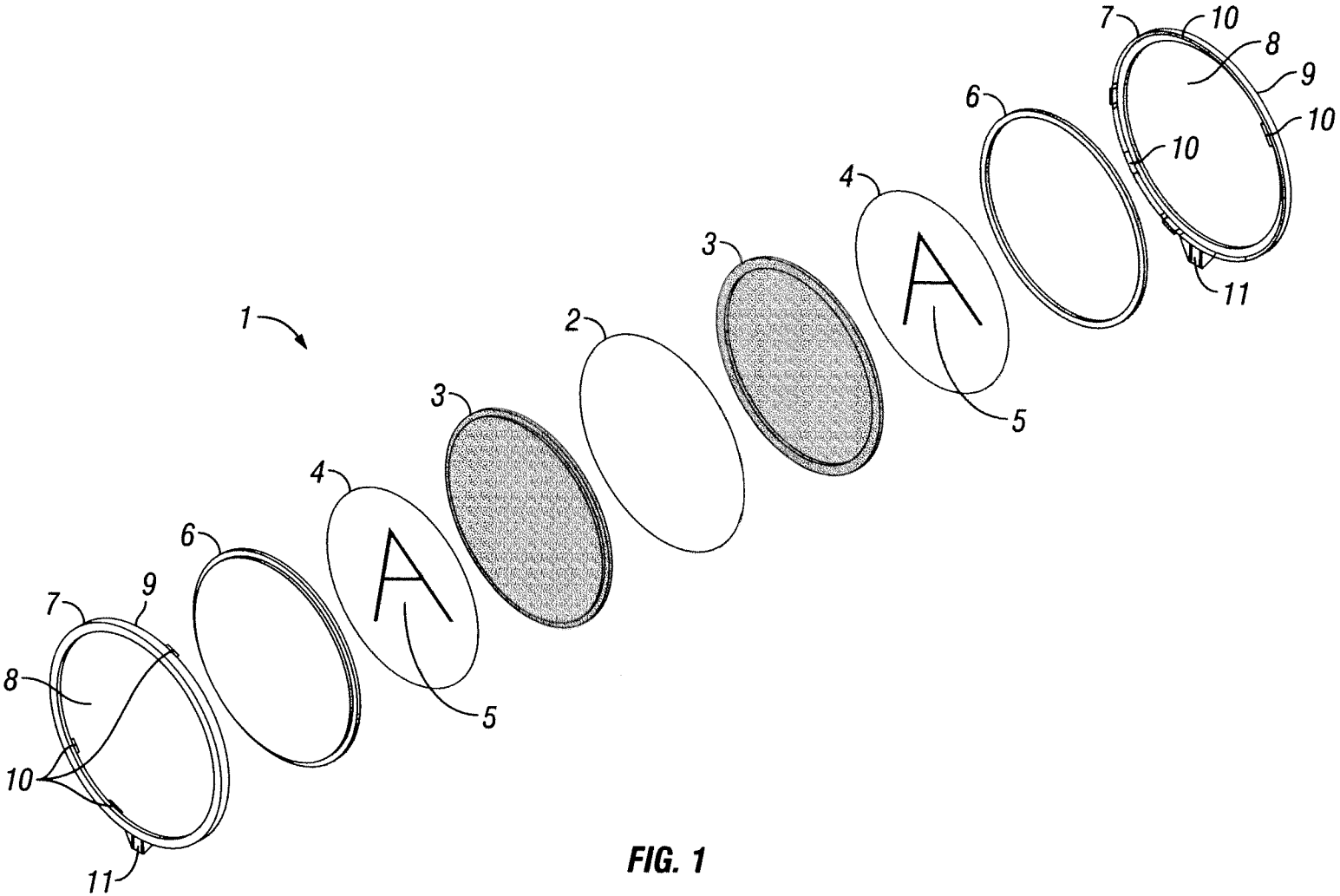
FIG. 1 is a perspective view of a disassembled retro-reflective graphic display.

FIG. 1 is a perspective view of a disassembled retro-reflective graphic display 1. In this embodiment, the display 1 is two sided and is round in shape. The innermost component of the retro-reflective graphic display 1 is a center backing member 2. The center backing member 2 is composed of high impact polystyrene in this embodiment, but other suitable materials may be used.

Interchangeable reflectors 3 are placed on both sides of the center backing member 2. The reflectors 3 are made of a reflective material with a multiplicity of retro-reflective cube corners formed on the inner sides of the reflectors 3. Retro-reflective cube corners are comprised of three approximately mutually perpendicular optical faces that cooperate to retroreflect incident light back towards the viewer. The cube corners are well known in the art and have often been used to construct roadway and automotive reflectors. The interchangeable reflectors 3 may be a number of different colors, and a user may swap out the reflectors 3 for a color of their choosing. The interchangeable reflectors 3 may be composed of acrylic, but other suitable materials may also be used.

Front and back graphics 4 are placed on the outer side of the interchangeable reflectors 3. In this embodiment, the graphics 4 include images 5 that are incorporated onto the surface of a transparent material. The images 5 are represented by the letter "A" in this example, but any image, character, or numeral may be used. The graphics 4 in this embodiment are interchangeable. In other embodiments, the graphics 4 may be comprised of images 5 incorporated directly onto the surface of the reflectors 3.

Front and back clear lenses 6 are placed on the outer side of the graphics 4. The lenses 6 in one embodiment are composed of clear high impact polystyrene, but other optically transmissive materials may be used. In one embodiment, the graphics 4 may be comprised of images 5 incorporated directly onto the inner surface of the lenses 6.

Front and back covers 7 are placed on the outer side of the clear lenses 6. The covers 7 are molded to form a frame around the center backing member 2, the interchangeable reflectors 3, the graphics 4, and the clear lenses 5. The covers 7 form an aperture 8 through which the lenses 6, the graphics 4, the reflectors 3, and the backing member 2 may be seen. The covers 7 may be composed of high impact polystyrene, but other suitable materials may be used.

The inner edges 9 of the covers 7 incorporate a means for fastening the inner edges 9 of the covers 7 together to retain the lenses, graphics 4, reflectors 3, and backing member within the covers 7 in a non-adhesive manner. In one embodiment, a plurality of clips 10 incorporated into the covers' 7 inner edges 9 fastens the covers 7, but other fastening means ma be used.

The retro-reflective graphic display 1 may be mounted on top of a stake for display. An aperture 11 for receiving a stake is incorporated into this embodiment. Other mounting means may include, but are not limited to, apertures for receiving a hook, nail, or other fastener. The display 1 could also be mounted using an adhesive such as two-sided tape.

Figure 2:
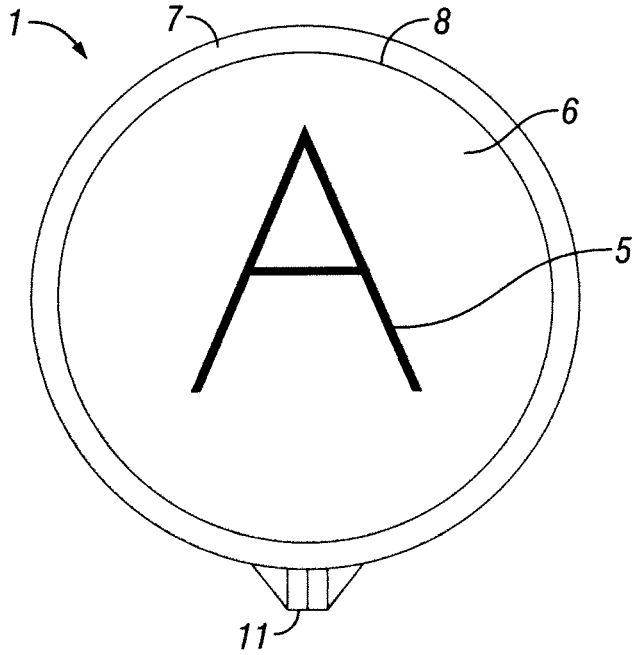
FIG. 2 is a front view of the assembled round retro-reflective graphic display.

FIG. 2 is a front view of the assembled round retro-reflective graphic display 1. When viewed from this angle, the graphics' 4 images 5 are visible through the clear lenses 6. When light shines through the lenses 6, the reflectors 3 redirect the light back towards the viewer, enhancing the view of the graphics' 4 images 5.

Figure 3:
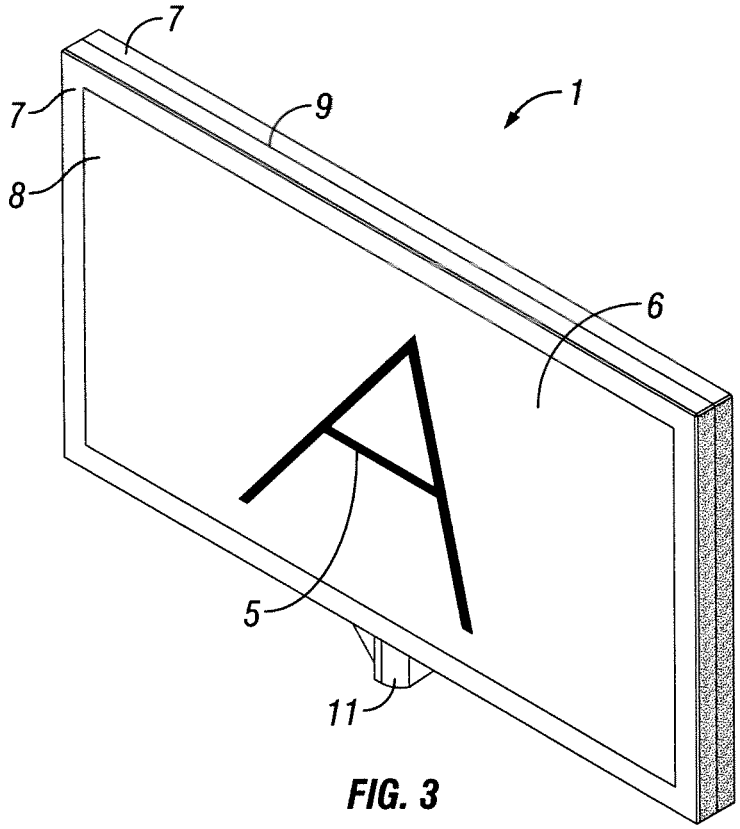
FIG. 3 is a perspective view of a rectangular retro-reflective graphic display.

The retro-reflective graphic display 1 may be manufactured in a number of shapes, including but not limited to a circle, rectangle, triangle, pentagon, hexagon, etc. The display 1 could similarly be made in the shape of a football, a football helmet, a cross, a waving flag, a tractor, or virtually any other shape. FIG. 3 is a perspective view of the retro-reflective graphic display 1 manufactured in a rectangle shape.

Figure 4:
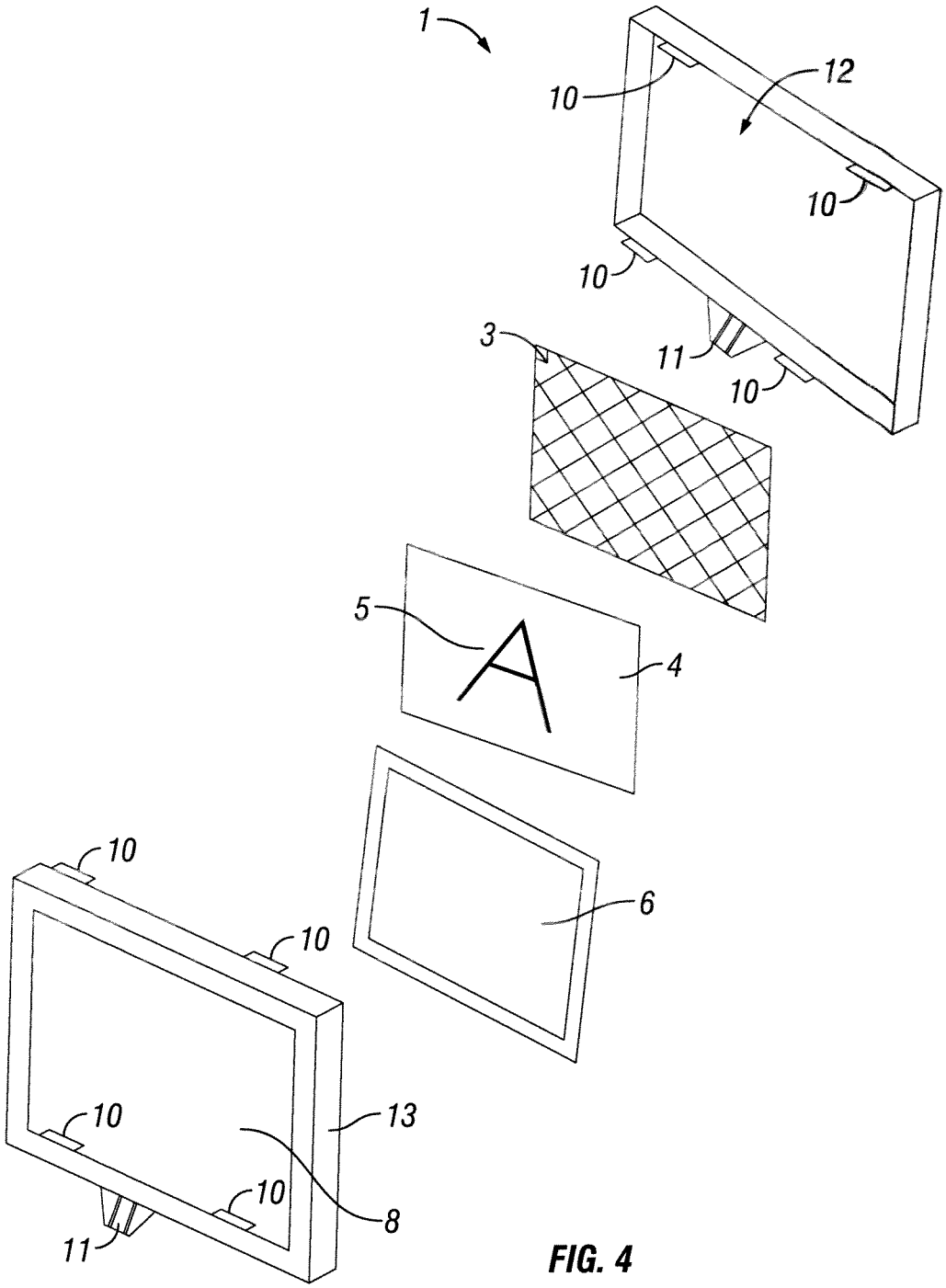
FIG. 4 is a perspective view of a disassembled rectangular one sided retro-reflective graphic display.

In another embodiment, the retro-reflective graphic display 1 may be one sided. FIG. 4 is a perspective view of a disassembled rectangular one sided retro-reflective graphic display 1. In this embodiment, the solid back cover 12 is molded to form the back portion of a frame and does not contain an aperture 8. One interchangeable reflector 3 is placed or the inside of the solid back cover 12, and one graphic 4 placed in front of the reflector 3. A clear lens 6 is placed in front of the graphic 4. The front cover 13 is molded to form a frame around the interchangeable reflector 3, the graphic 4, and the clear lens 6. The front cover 13 forms an aperture 8 through which the lens 6, graphic 4, and reflector 3 may be seen. When fastened together, the front cover 13 and back cover 12 secure the interchangeable reflector 3, graphic 4, and lens 6 in a non-adhesive manner.

The foregoing description of preferred embodiments for the retro-reflective graphic display invention is presented for the purposes of illustration and description. They are not intended to be exhaustive or to limit the invention to the precise form disclosed. Obvious modifications or variations are possible in light of the above teachings. The embodiments are chosen and described in an effort to provide the best illustration of the principles of the invention and its practical applications, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A retro-reflective graphic display comprising:

a center backing member;

front and back interchangeable reflectors placed on either side of the backing member, the reflectors being made of a material with a multiplicity of retro-reflective cube-corners formed on one side of the reflectors;

front and back graphics; the front and back graphics being made of a transparent material with images incorporated on the surface of the transparent material;

front and back clear lenses;

front and back covers placed around the lenses, the covers being molded to form a frame around the backing member, reflectors, graphics, and lenses, said covers having an aperture through which the lenses, graphics, reflector, and backing member may be seen, the inner edges of said covers incorporating a means for fastening the inner edges of the covers together to retain the lenses, graphics, reflectors, and backing member within the covers in a non-adhesive manner when the retro-reflective graphic display is assembled.

2. The retro-reflective graphic display of claim 1, further comprising an aperture for receiving a stake to support the display.

3. The retro-reflective graphic display of claim 1, further comprising an aperture for receiving a means to hang the display.

4. A retro-reflective graphic display comprising:

a center backing member;

front and back interchangeable reflectors placed on either side of the backing member, the reflectors being made of a material with a multiplicity of retro-reflective cube-corners formed on one side of the reflectors;

front and back graphics, the front and back graphics being figures incorporated on a surface of the front and back interchangeable reflectors;

front and back clear lenses;

front and back covers placed around the lenses, the covers being molded to form a frame around the backing member, reflectors, graphics, and lenses, said covers having an aperture through which the lenses, graphics, reflector, and backing member may be seen, the inner edges of said covers incorporating a means for fastening the inner edges of the covers together to retain the lenses, graphics, reflectors, and backing member within the covers in a non-adhesive manner when the retro-reflective graphic display is assembled.

5. The retro-reflective graphic display of claim 4, further comprising an aperture for receiving a stake to support the display.

6. The retro-reflective graphic display of claim 4, further comprising an aperture for receiving a means to hang the display.

7. A retro-reflective graphic display comprising:

a center backing member;

front and back interchangeable reflectors placed on either side of the backing member, the reflectors being made of a material with a multiplicity of retro-reflective cube-corners formed on one side of the reflectors;

front and back clear lenses;

front and back graphics, the front and back graphics being figures incorporated on a surface of the front and back clear lenses;

front and back covers placed around the lenses, the covers being molded to form a frame around the backing member, reflectors, graphics, and lenses, said covers having an aperture through which the lenses, graphics, reflector, and backing member may be seen, the inner edges of said covers incorporating a means for fastening the inner edges of the covers together to retain the lenses, graphics, reflectors, and backing member within the covers in a non-adhesive manner when the retro-reflective graphic display is assembled.

8. The retro-reflective graphic display of claim 7, further comprising an aperture for receiving a stake to support the display.

9. The retro-reflective graphic display of claim 7, further comprising an aperture for receiving a means to hang the display.

* * * * *